US006551021B2

(12) United States Patent
Baker

(10) Patent No.: US 6,551,021 B2
(45) Date of Patent: Apr. 22, 2003

(54) SCREED PLATE INTERLOCK

(75) Inventor: Adrian Baker, Charleston, IL (US)

(73) Assignee: Blaw-Knox Construction Equipment Corporation, Mattoon, IL (US)

( * ) Notice: Subject to any disclaimer, the term of this patent is extended or adjusted under 35 U.S.C. 154(b) by 0 days.

(21) Appl. No.: 09/778,423

(22) Filed: Feb. 7, 2001

(65) Prior Publication Data

US 2002/0106244 A1 Aug. 8, 2002

(51) Int. Cl.[7] ..... E01C 19/22
(52) U.S. Cl. ..... 404/118
(58) Field of Search ..... 404/104, 105, 404/118; 15/235.4; 403/341, 345, 364

(56) References Cited

U.S. PATENT DOCUMENTS

| | | | | | |
|---|---|---|---|---|---|
| 1,220,986 | A | * | 3/1917 | Henderson | 404/118 |
| 4,095,913 | A | * | 6/1978 | Pettersson et al. | 217/96 |
| 4,427,358 | A | | 1/1984 | Stilwell | |
| 4,492,490 | A | * | 1/1985 | Christine et al. | 296/184 |
| 4,591,291 | A | * | 5/1986 | Owens | 404/118 |
| 4,688,965 | A | * | 8/1987 | Smith et al. | 404/118 |
| 4,865,487 | A | | 9/1989 | Lutz | |
| 4,900,185 | A | * | 2/1990 | Foertsch | 404/104 |
| 4,915,610 | A | * | 4/1990 | Curry | 15/235.4 |
| 4,931,008 | A | | 6/1990 | Morrison | |
| 5,292,040 | A | * | 3/1994 | McKim | 222/612 |
| 5,303,445 | A | * | 4/1994 | Meyers | 15/235.4 |
| 5,348,418 | A | * | 9/1994 | Campbell | 404/103 |
| 5,366,320 | A | | 11/1994 | Hanlon et al. | |
| 5,468,095 | A | * | 11/1995 | Dawson | 404/118 |
| 5,632,569 | A | * | 5/1997 | Szmansky | 15/235.4 |
| 5,647,688 | A | * | 7/1997 | Guntert et al. | 280/638 |
| 5,687,448 | A | * | 11/1997 | Dye, Jr. | 15/144.1 |
| 5,702,202 | A | * | 12/1997 | Schleiter | 404/104 |
| 6,074,129 | A | | 6/2000 | Nowak et al. | |
| 6,393,788 | B1 | * | 5/2002 | Flores | 108/27 |

* cited by examiner

*Primary Examiner*—Gary S. Hartmann
(74) *Attorney, Agent, or Firm*—Michael Best & Friedrich LLP

(57) ABSTRACT

The screed assembly includes a screed plate and a screed frame. The screed plate includes a notch and the screed frame includes a tab that is inserted into the notch on the screed frame such that only screed plates and screed frames which include proper mating notches and tabs may be assembled together on road paving machines. In a preferred form of the invention, the width of the tab is approximately equal to the width of the notch to prevent lateral movement of the screed plate with respect to the screed frame when the screed plate is subjected to lateral impacts and forces during operation of the road paving machine.

18 Claims, 4 Drawing Sheets

SCREED PLATE INTERLOCK

FIELD OF THE INVENTION

The invention relates to road paving machines, and more particularly to a screed assembly used in a road paving machine.

BACKGROUND OF THE INVENTION

Road paving machines are used to deposit, spread, and compact an aggregate-filled tar-based paving material onto a prepared road bed to form a hard pavement surface. Road paving machines include a heavy metal plate called a screed plate that is used to level and compress newly deposited paving material into a compact layer.

The screed plates that are used in conventional road paving machines are usually coupled to a screed frame by a series of fasteners. The screed frame is connected to the rear end of the road paving machine frame.

A typical screed plate includes a curved leading edge that facilitates leveling the paving material and prevents accumulated paving material from overflowing onto the top of the screed plate. The curved leading edge of the screed plate is commonly positioned in a substantially vertical plane such that when the screed plate is coupled to the screed frame, the curved leading edge is positioned adjacent to a bottom surface on the screed frame. This interface between the screed plate and the screed frame is substantially planar which allows replacement screed plates to be easily manufactured and results in the interchangeability of the screed plates between different paving machines.

The above described screed assemblies are generally effective for leveling and compressing deposited paving material to form a paved road. Therefore, any improvement in the design or manufacture of such screed assemblies would be desirable.

SUMMARY OF THE INVENTION

The present invention is directed to a screed assembly for a road paving machine. The screed assembly levels and compresses newly deposited paving material into a compact layer over a prepared road bed.

The screed assembly of the present invention is configured with specialized mating components so that only appropriate replacement screed plates may be installed onto particular road paving machines. The mating components on the screed plate assembly of the present invention also prevent lateral movement of the screed plate relative to the screed frame when the screed plate is subjected to lateral impacts and forces during operation of the road paving machine. The components in the screed assembly are also easily manufactured and simply modified so that the mating components on the screed assembly may be varied from one road paving machine to another road paving machine. The screed plates are preferably configured such that the screed plates remain compatible with the screed frames on older road paving machines.

The screed assembly includes a screed plate and a screed frame. The screed plate includes a notch and the screed frame includes a tab that is inserted into the notch on the screed frame such that only screed plates and screed frames which include proper mating notches and tabs may be assembled together on road paving machines. In a preferred form of the invention, the width of the tab is approximately equal to the width of the notch to prevent lateral movement of the screed plate with respect to the screed frame when the screed plate is subjected to lateral impacts and forces during operation of the road paving machine.

The method of promoting the use of appropriate replacement screed plates on road paving machines includes: manufacturing a first screed plate that includes a first notch; manufacturing a first screed frame that includes a first tab which is inserted into the notch of the first screed plate when the first screed plate is assembled to the first screed frame; manufacturing a second screed plate that includes a second notch; manufacturing a second screed frame that includes a second tab which is inserted into the notch of the second screed plate when the second screed plate is assembled to the second screed frame, such that the first screed plate cannot be coupled to the second screed frame because the second tab on the second screed frame does not fit into the first notch on the first screed plate.

Other features and advantages of the invention will become apparent to those skilled in the art upon review of the following detailed description, claims, and drawings.

Figure 1:
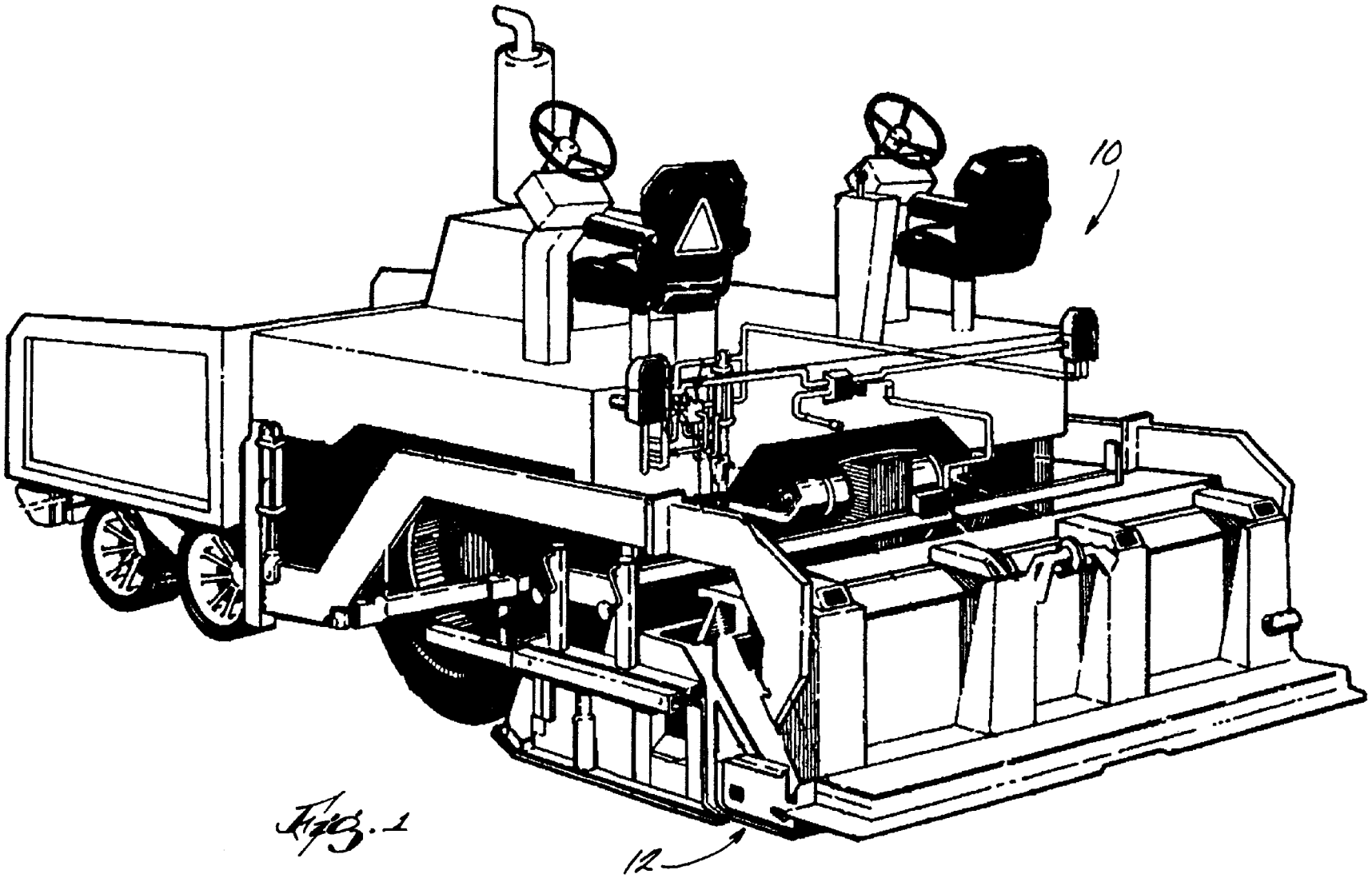
FIG. 1 is a perspective view of a road paving machine including a screed assembly of the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION OF THE INVENTION

Figure 2:
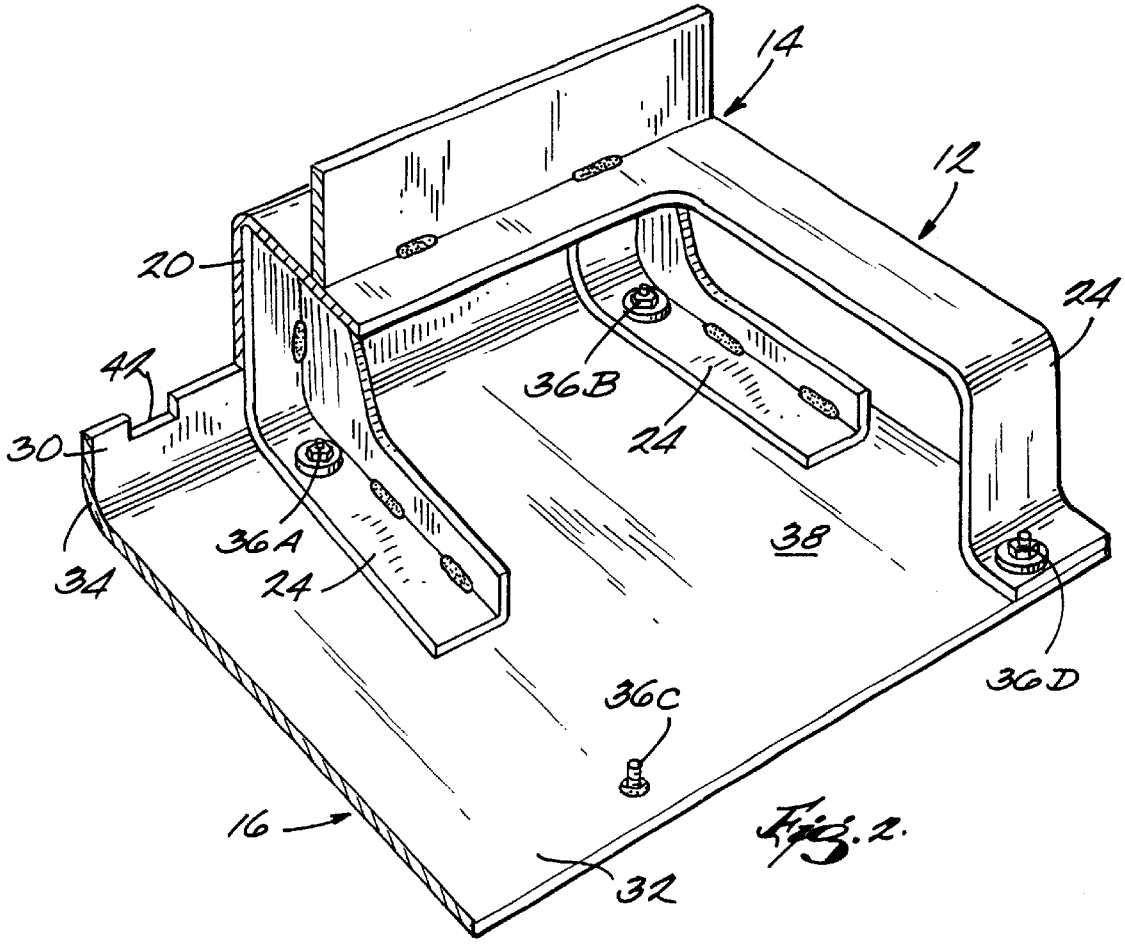
FIG. 2 is a perspective view illustrating the screed assembly of the present invention.

FIG. 1 illustrates a road paving machine 10 that includes a screed assembly 12 of the present invention. As shown in FIG. 2, the screed assembly 12 includes a screed frame 14 that is connected to a rear portion of the road paving machine 10 and a screed plate 16 that is connected to the screed frame 14.

The screed frame 14 includes a plurality of supports 24 that are coupled to the screed plate 16. The screed frame 14 also includes a front portion 20 that extends downward toward the screed plate 16. Although three supports 24 are shown in FIG. 2, it should be understood that the number and type of supports 24 that are used to connect the screed frame 14 to the screed plate 16 may vary without departing from the scope of the present invention.

The screed plate 16 includes a first portion 30, a second portion 32 and an intermediate portion 34 that connects the first and second portions 30, 32 together. The first portion 30 is in substantially the same plane as the front portion 20 of the screed frame 14 and is preferably the same thickness as the front portion 20. The intermediate portion 34 is a substantially smooth curve that connects the first portion 30 with the second portion 32 such that the first portion 30 is substantially perpendicular to the second portion 32. The first portion 30 and the intermediate portion 34 of the screed plate 16 spread the paving material as the screed plate 16 initially passes over paving material. The flat second portion 32 of the screed plate 16 compresses the paving material into a substantially flat layer as the remainder of screed plate 16 passes over the paving material.

The second portion 32 of the screed plate 16 includes studs 36A, 36B, 36C, 36D that are welded to a top surface 38 on the second portion 32 and are inserted through holes located on the lower supports 24 of the screed frame 14. Conventional washers and nuts are fastened to the bolts 36 to secure the screed plate 16 to the screed frame 14. Although only four studs 36 are shown in FIG. 2, it should be understood that additional studs or other means of fastening the screed plate 16 to the screed frame 14 may be used without departing from the scope of the present invention.

Figure 3:
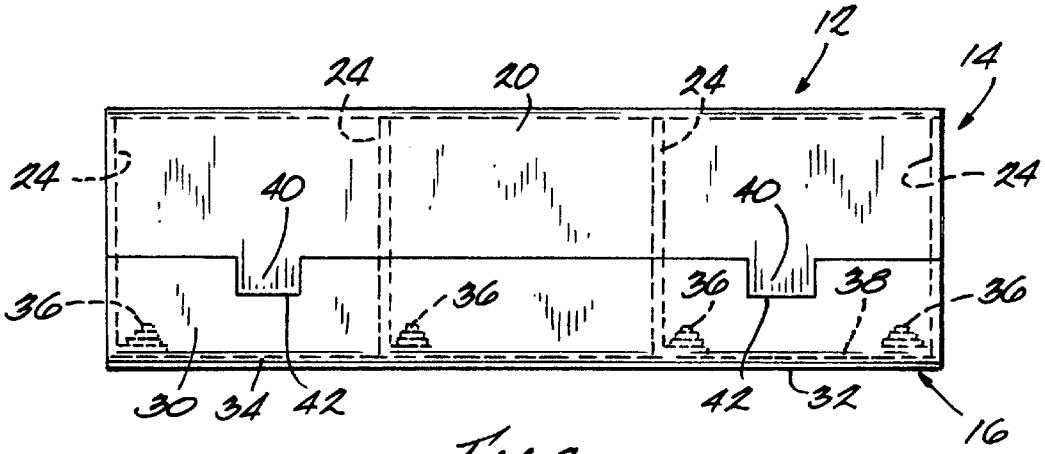
FIG. 3 is a front view of the screed assembly of FIG. 2, illustrating tabs on the screed frame inserted into mating notches on the screed plate.

As shown in FIG. 3, the front portion 20 of the screed frame 14 includes at least one tab 40 that projects downwardly from the front portion 20 and is preferably integral with the front portion 20. The tab 40 is also preferably the same thickness as the front portion 20 and is in substantially the same plane as the front portion 20 of the screed frame 14. The number and the configuration of the tabs 40 are designed to be variable to ensure that only certain appropriate screed plates are placed onto selected road paving machines. The number, size, thickness and location of the tabs 40 along the front portion 20 may each vary while still embodying the invention.

The first portion 30 of the screed plate 16 includes at least one notch 42 such that when the screed plate 16 is coupled to the screed frame 14, the tab 40 on the screed frame 14 is inserted into the notch 42 on the screed plate 16. The width and thickness of the notch 42 are preferably equal to the width and thickness of the tab 40 such that the tab 40 occupies the entire void defined by the notch 40 when the screed plate 16 is coupled to the screed frame 14. Matching the width of the notch 42 to the width of the tab 40 prevents the screed plate 16 from moving in a lateral direction relative to the screed frame 14 when the screed plate 16 is subjected to lateral impacts and forces during operation of the road paving machine 10. The number and configuration of the notches 42 on the screed plate 16 preferably correspond to the number of tabs 40 on the screed frame 14. In an alternative embodiment, the tabs 40 are located on the first portion 30 of the screed plate 16 and the notches 42 are located on the front portion 20 of the screed frame 14.

The tab 40 and notch 42 configuration ensures that only screed plates 16 and screed frames 14 that include proper mating notches 42 and tabs 40 may be assembled together on road paving machines 10. A manufacturer is able to produce a first road paving vehicle that includes one tab/notch configuration and a second road paving vehicle that includes a different tab/notch configuration such that the screed plate 16 on the second road paving machine will not properly connect with the screed frame 14 on the first road paving machine and the screed plate 16 of the first road paving machine will not properly connect with the screed frame 14 of the second road paving machine. Therefore, the road paving machine users are required to purchase and install an appropriate replacement screed plate 16 for a particular road paving machine 10.

Figure 4:
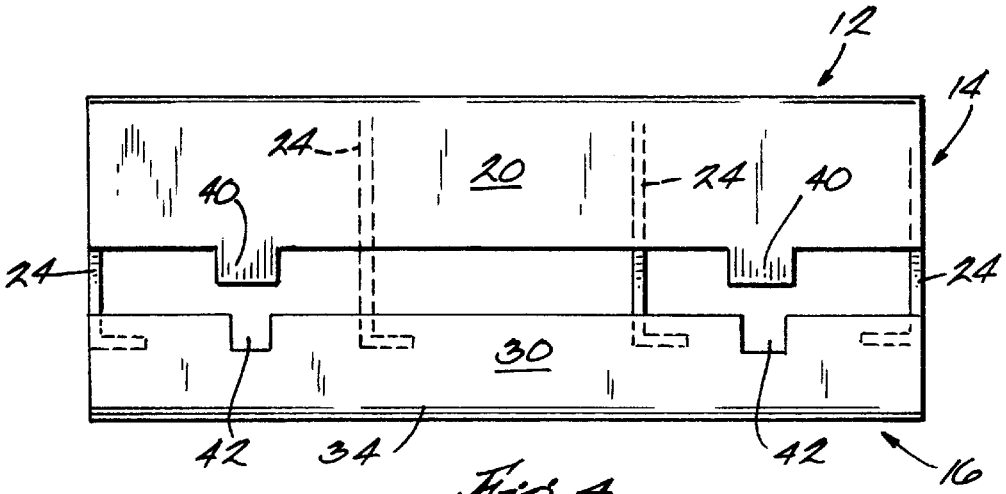
FIG. 4 is a view similar to FIG. 3, illustrating the tabs on the screed frame and non-mating notches on the screed plate.

FIG. 4 illustrates one form of a non-mating interface between the tab 40 on the screed frame 14 and the notch 42 on the screed plate 16 that prevents the screed plate 16 from being mounted to the screed frame 14. The screed plate 16 cannot be mounted to the screed frame 14 because the notches 42 are too narrow to accept the width of the tabs 40.

Figure 5:
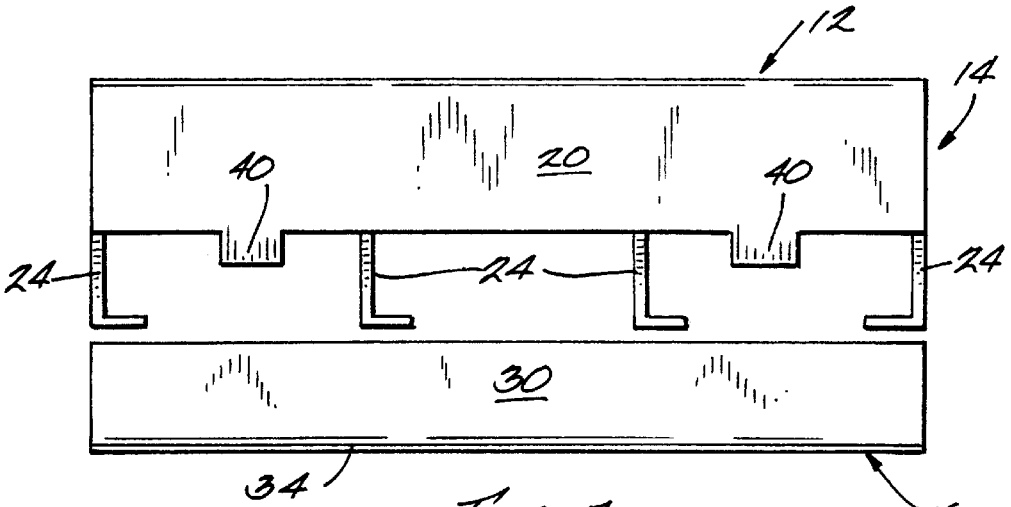
FIG. 5 is a view similar to FIG. 3, illustrating the screed plate without notches.

FIG. 5 illustrates a non-mating interface between a conventional screed plate 16 and a screed frame 14. The conventional screed plate 16 cannot be properly mounted to the particular screed frame 14 because the conventional screed plate 16 does not include any notches 42 that correspond to the tabs 40 on the screed frame 14.

Figure 6:
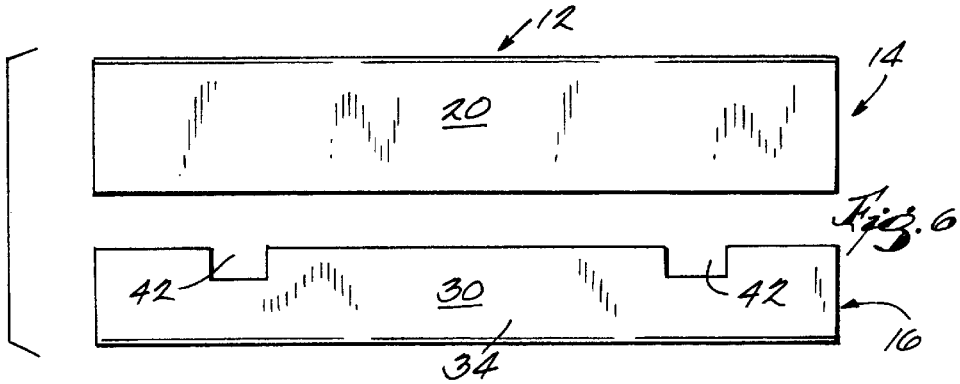
FIG. 6 is a view similar to FIG. 3, illustrating the screed frame without tabs.

FIG. 6 illustrates a mating surface between a conventional screed frame 14 and a modified screed plate 16. The conventional screed frame 14 does not include tabs such that the screed plate 16, which includes notches 42 can be properly mounted to the screed frame 14. Therefore, screed plates 16 that are made according to the present invention may be mounted to the conventional screed frames 14 which are found on older road paving machines 10.

Figure 7:
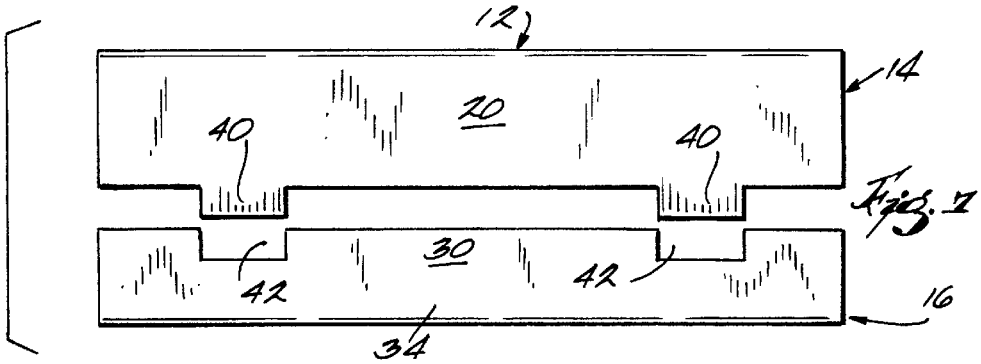
FIG. 7 is a view similar to FIG. 3, illustrating a screed assembly with wider tabs and notches.
Figure 8:
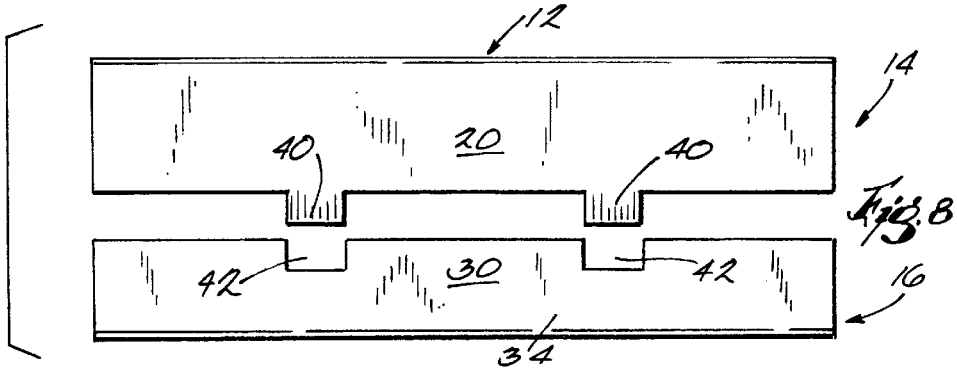
FIG. 8 is a view similar to FIG. 3, illustrating the tabs and the notches at different relative positions along the length of the screed frame and the screed plate.
Figure 9:
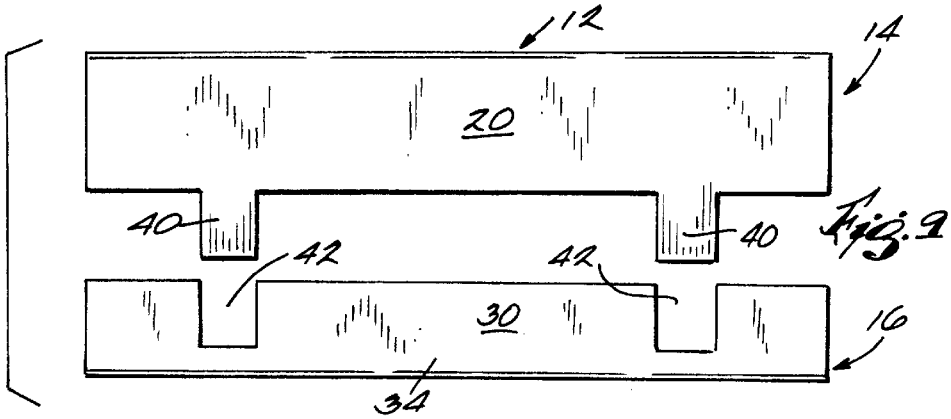
FIG. 9 is a view similar to FIG. 3, illustrating longer tabs and notches.

FIGS. 7–9 illustrate how the characteristics of the tabs 40 and notches 42 may be varied while still providing the mating interface between the screed plate 16 and the screed frame 14. It should be noted that the invention may include any number of mating tabs 40 and notches 42 without departing from the scope of the present invention.

FIG. 7 illustrates a screed assembly 12 that includes tabs 40 and notches 42 which are wider than the screed assembly 12 illustrated in FIG. 3.

FIG. 8 illustrates a screed assembly 12 that includes tabs 40 and notches 42 which are located at a different lateral positions along the screed plate 16 and the screed frame 14 when compared to the screed assembly 12 illustrated in FIG. 3.

FIG. 9 illustrates a screed assembly 12 that includes tabs 40 and notches 42 which are deeper than the tabs 40 and notches 42 of the screed assembly 12 illustrated in FIG. 3.

Figure 10:
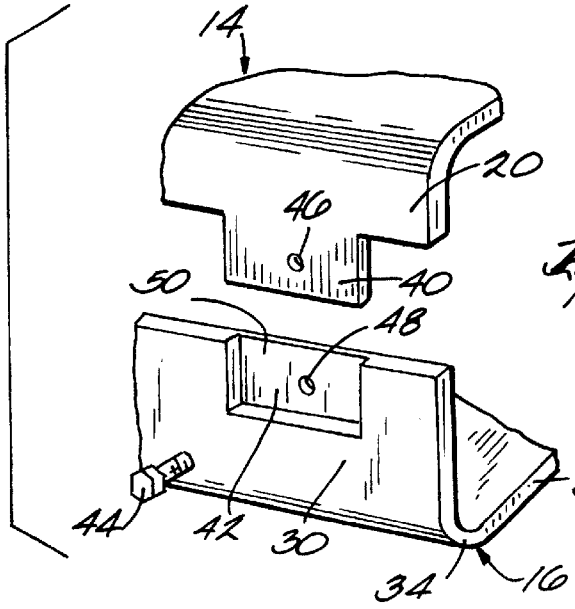
FIG. 10 is an exploded perspective view of the screed assembly of FIG. 3 illustrating a tab and notch configuration that facilitates using a fastener.

FIG. 10 illustrates another configuration for the tab/notch combination where the tab 40 is fastened within the notch 42 by inserting a fastener 44 through a hole 46 located on the tab 40 and a hole 48 located on a portion 50 of the screed plate 16 that is adjacent to the notch 42. The tab 40 is preferably half the thickness of the front portion 20 on the screed frame 14 and the notch 42 is preferably half the thickness of the first portion 30 on the screed plate 16. When the tab 40 is inserted into the notch 42, the combined thickness of the portion 50 adjacent to the notch 42 and the tab 40 is approximately equal to the thickness of the first portion 30 on the screed plate 16 and the front portion 20 on the screed frame 14.

I claim:

1. A screed assembly for a paving vehicle, the screed assembly comprising:

a frame connectable with the vehicle and including a tab; and a screed plate having a first, generally vertical wall portion including a notch, the notch extending into the wall portion so as to be at least partially bounded by two facing surface sections of the plate, and a second, generally horizontal wall portion connectable with the frame, the notch being configured to receive the frame tab such that when the plate second portion is connected with the frame, the tab is disposed within the notch generally between the two plate surfaces and the mating tab and notch generally prevent lateral movement of the plate relative to the frame.

2. The screed assembly of claim 1, wherein a portion of the screed plate is positioned in a substantially vertical plane.

3. The screed assembly of claim 2, wherein the tab and the notch are in substantially the same plane.

4. The screed assembly of claim 1, wherein the screed plate further includes a planar first portion that is in substantially the same plane as the tab and a second portion that is substantially perpendicular to the first portion, the notch being located on the first portion.

5. The screed assembly of claim 4, wherein the screed plate further includes an intermediate portion connecting the first portion and the second portion, the intermediate portion being a substantially smooth curve.

6. The screed assembly of claim 1, wherein the tab includes a thickness and the screed frame includes a thickness, the thickness of the tab being less than the thickness of the screed frame.

7. The screed assembly of claim 1, wherein the screed plate includes a thickness and the notch includes a depth that is less than the thickness of the screed plate.

8. The screed assembly of claim 1 of the notch is equal to the thickness of the screed plate such that the notch extends completely through the screed plate.

9. The screed assembly of claim 7, wherein the depth of the notch is about one half the thickness of the screed plate.

10. The screed assembly of claim 7, wherein the screed plate is coupled to the screed frame by a fastener inserted through the tab and a portion of the screed plate adjacent to the notch.

11. The screed assembly of claim 10, wherein the tab and the portion of the screed plate adjacent to the notch each include a hole.

12. The screed assembly of claim 1, wherein the tab includes a width and the notch includes a width, the width of the tab being approximately equal to the width of the notch such that when the tab is inserted within the notch the screed plate is prevented from moving in a lateral direction relative to the screed frame.

13. The screed assembly of claim 1, wherein the tab is integrally formed with the screed frame.

14. The screed assembly of claim 1, wherein the screed frame includes a plurality of tabs and the screed plate includes a plurality of notches for receiving the plurality of tabs.

15. The screed assembly of claim 14, wherein the plurality of tabs are equally spaced from each other.

16. The screed assembly of claim 15, wherein the plurality of tabs are substantially equal in size.

17. A screed assembly for a paving vehicle, the screed assembly comprising:

a frame connectable with the paving vehicle and having a wall portion including a notch, the notch extending into the wall portion so as to be at least partially bounded by two facing surface sections of the wall portion; and a screed plate having a first, generally vertical wall portion including a tab, the tab being integrally formed with the vertical wall portion, and a second, generally horizontal wall portion connectable with the frame, the tab being disposable within the frame notch such that when the plate second portion is connected with the frame, the tab is disposed within the notch between the two wall surface sections and the mating tab and notch generally prevent lateral movement of the plate relative to the frame.

18. A screed assembly for a paving vehicle, the screed assembly comprising:

a frame connectable with the vehicle and including a tab; and a screed plate having a first portion including a notch and a second portion connectable with the frame, the plate having a thickness and the notch having a depth that is less than the thickness of the plate, the notch being configured to receive the frame tab such that when the plate second portion is connected with the frame, the tab is disposed within the notch and the mating tab and notch generally prevent lateral movement of the plate relative to the frame.

* * * * *